US005318381A

United States Patent [19]

Enami et al.

[11] Patent Number: 5,318,381

[45] Date of Patent: Jun. 7, 1994

[54] COLLAPSIBLE RUBBER DAM

[75] Inventors: Yasushi Enami; Shunji Mitani; Yoshihiro Sato, all of Yokohama, Japan

[73] Assignee: Bridgestone Corporation, Tokyo, Japan

[21] Appl. No.: 692,968

[22] Filed: Apr. 29, 1991

Related U.S. Application Data

[63] Continuation of Ser. No. 467,465, Jan. 19, 1990, abandoned.

[30] Foreign Application Priority Data

Jan. 20, 1989 [JP] Japan ..... 1-9646

[51] Int. Cl.[5] ..... E02B 7/20

[52] U.S. Cl. ..... 405/115; 405/91

[58] Field of Search ..... 405/115, 114, 91, 87

[56] References Cited

U.S. PATENT DOCUMENTS

| | | | |
|---|---|---|---|
| 1,885,057 | 10/1932 | Karpov | 405/114 |
| 3,173,269 | 3/1965 | Imbertson | 405/115 X |
| 3,568,453 | 3/1971 | Ziegenmeyer | 405/115 X |
| 3,928,980 | 12/1975 | Ganzinotti | 405/91 |
| 4,031,676 | 6/1977 | Dally | 405/114 X |
| 4,299,514 | 11/1981 | Muramatsu et al. | 405/115 |
| 4,352,591 | 10/1982 | Thompson | 405/115 X |
| 4,498,810 | 2/1985 | Muramatsu et al. | 405/115 |
| 4,661,015 | 4/1987 | Tsuji et al. | 405/115 |
| 4,799,821 | 1/1989 | Brodersen | 405/115 |

FOREIGN PATENT DOCUMENTS

| | | | |
|---|---|---|---|
| 0021610 | 2/1982 | Japan | 405/115 |
| 0188510 | 9/1985 | Japan | 405/115 |
| 0078307 | 4/1987 | Japan | 405/115 |
| 0019316 | 1/1988 | Japan | 405/115 |
| 0033367 | 10/1921 | Norway | 405/115 |
| 0669002 | 6/1979 | U.S.S.R. | 405/115 |

OTHER PUBLICATIONS

Patent Abstracts of Japan, vol. 10, No. 277 (M159)[2333], Sep. 19, 1986, p. 2333 M519; & JP-A-61 98 811 (Hitachi Zosen Corp.) May 17, 1986 *Abstract*.

*Primary Examiner*—Dennis L. Taylor
*Attorney, Agent, or Firm*—Sughrue, Mion, Zinn, Macpeak & Seas

[57] ABSTRACT

In a collapsible rubber dam, a fastening portion of a flexible rubber sheet body is fixed on an upper spillway portion of an arch type concrete dam or on a riverbed of a river in a curved form in the longitudinal direction of the body.

5 Claims, 6 Drawing Sheets

COLLAPSIBLE RUBBER DAM

This is a continuation of application Ser. No. 07/467,465 filed Jan. 19, 1990, now abandoned.

BACKGROUND OF THE INVENTION

1. Field of the Invention

This invention relates to a collapsible rubber dam comprised of a flexible dam body and disposed on a spillway portion of a concrete dam or in a watercourse of a river.

2. Related Art Statement

In general, flexible rubber bag bodies inflated and deflated through supply and discharge of air or so-called rubber dams disposed on river or the like are widely used because they are simple in working execution and inexpensive in production cost.

For example, such a rubber dam is used as a level raising member for a concrete dam, wherein the flexible rubber bag body is attached to an upper spillway portion of the concrete dam through anchor bolts embedded in the upper spillway portion. When the concrete dam is an arch-type dam 01 as shown in FIG. 12, the full width of a spillway portion is divided into some sections and a pier 03 is arranged in each of the divided positions. Then, a rubber bag 04 is arranged between the piers 03, in which the straight portion in the longitudinal direction of the bag is fixed through a fastening member 05 with anchor bolts 06 and each end portion 07 of the bag is fixed to the respective pier 03. Thus, the rubber dam comprised of plural rubber bags is rendered into a convex form folded at the pier position as a whole.

When the rubber dam is arranged in the general river, as shown in FIG. 13, a concrete 010 is placed from a riverbed 08 to each of riverbanks 09 in the widthwise direction of the river to form a dam base portion. Many anchor bolts 06 are embedded in the base portion, and also piers 03 are stud on the base portion at a proper interval in the widthwise direction of the river. Thereafter, a rubber bag 04 is arranged between the piers 03, in which the portion in the longitudinal direction of the bag is fixed through a fastening member 05 with the above anchor bolts 06 and each end portion 07 of the bag is fixed to the respective pier 03.

In the above conventional technique of arranging the rubber dam on the spillway of the arch type dam or the like, however, the piers for fixing the both ends of the rubber bag should be arranged at some positions on the spillway portion, so that working execution takes considerable time and labor and the cost rises. Furthermore, the spillway portion takes a curved form owing to the arch type as shown in FIG. 12, so that when the rubber bag is straightly fixed between the piers, the fixing positions against the anchor bolts gradually shift from the center of the spillway portion on the above curved face as seen from numerals 013, 014 in FIG. 12. As a result, the height of the rubber dam becomes ununiform.

On the other hand, when the rubber dam is arranged in the watercourse of the general river as shown in FIG. 13, the bank protection may be injured by overflowing water, rolling stones, drifting wood and the like falling down in parallel with the riverbank, and further vibrations of the rubber bag are apt to be easily caused by the overflowing water.

SUMMARY OF THE INVENTION

It is, therefore, an object of the invention to overcome the aforementioned problems of the conventional technique and to provide a collapsible rubber dam being easy in the working execution without arranging the pier in the watercourse.

According to the invention, there is the provision of a collapsible rubber dam, characterized in that a fastening portion of a flexible rubber sheet body inflating and deflating through supply and discharge of air is fixed on an upper spillway portion of an arch type concrete dam or on a riverbed of a river in a curved form in the longitudinal direction of the body.

In the rubber dam according to the invention, therefore, water pressure is substantially equally applied to the curved fastening portion of the flexible rubber sheet body and also vibration of the sheet body is sufficiently suppressed.

BRIEF DESCRIPTION OF THE DRAWINGS

The invention will be described with reference to the accompanying drawings, wherein.

DESCRIPTION OF THE PREFERRED EMBODIMENTS

Figure 1:
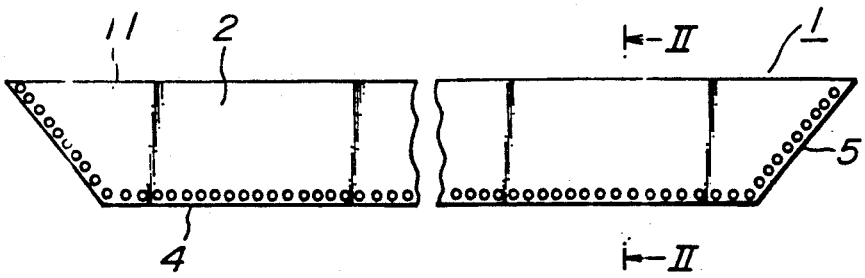
FIG. 1 is a plan view of the flexible rubber sheet body according to the invention.
Figure 2:
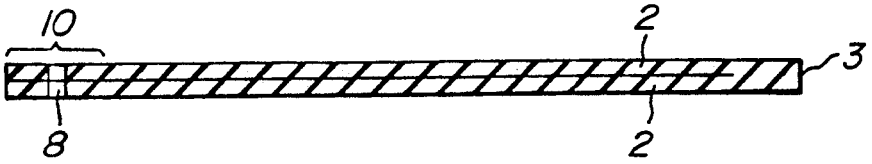
FIG. 2 is a sectional view taken along a line II—II of FIG. 1.

As shown in FIGS. 1 and 2, the collapsible rubber dam according to the invention is comprised of a flexible rubber sheet body 1, wherein a continuous length rubberized cloth 2 is folded at its center 3 in widthwise direction to overlap straight and longitudinal edges 4 of the folded portions with each other and widthwisely slant edges 5 with each other, respectively. Further, plural bolt holes 8 for fixing the sheet body are formed in the overlapped end portion at a proper and small interval to constitute a fastening portion 10 of the flexible rubber sheet body 1 against anchor bolts 9 as mentioned later. Moreover, the folded part in the vicinity of the center 3 of the rubberized cloth 2 is reinforced with a core material (not shown) having a proper length to form a fin 11 (see FIG. 10).

In an illustrated embodiment of FIGS. 3 to 10, the above flexible rubber sheet body 1 is fixed onto an upper spillway portion 13 of an arch type concrete dam 12, wherein many anchor bolts 9 are embedded at their root portions together with respective foundation fittings 15 in a concrete base of the spillway portion 13 along a curvature of the arch form. Then the bolt holes 8 pierced in the overlapped portion of the rubberized cloth 2 are fitted into the respective anchor bolts 9 and a pushing member 16 is placed thereon so as to sandwich the overlapped portion between the foundation fittings and the pushing member and to air-and water-tightly fasten through nuts 17 (see FIG. 6).

Figure 3:
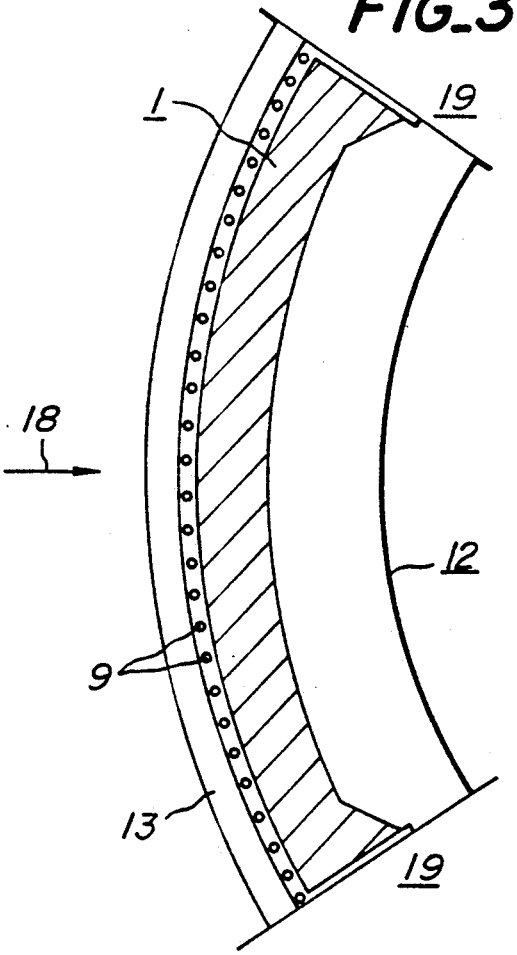
FIG. 3 is a plan view showing a state of attaching the flexible rubber sheet body onto an arch type concrete dam.
Figure 4:
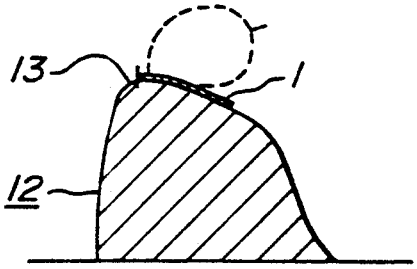
FIG. 4 is a sectional view of FIG. 3.

As shown in FIG. 3, the anchor bolts 9 embedded in the concrete base are arranged toward the upstream side from a side wall 19 of a watercourse 18 in an arc form taking a center of the watercourse 18 as a curvature center at an interval meeting with the interval between the bolt holes 8 of the rubber sheet body 1. That is, the straight overlapped portion of the rubber sheet body 1 is fixed onto the concrete base in an arc form as a whole while being gradually folded at a small angle in the position of the bolt hole 8. Also, the both slantly overlapped edge portions are fixed to both side walls 19.

Figure 5:
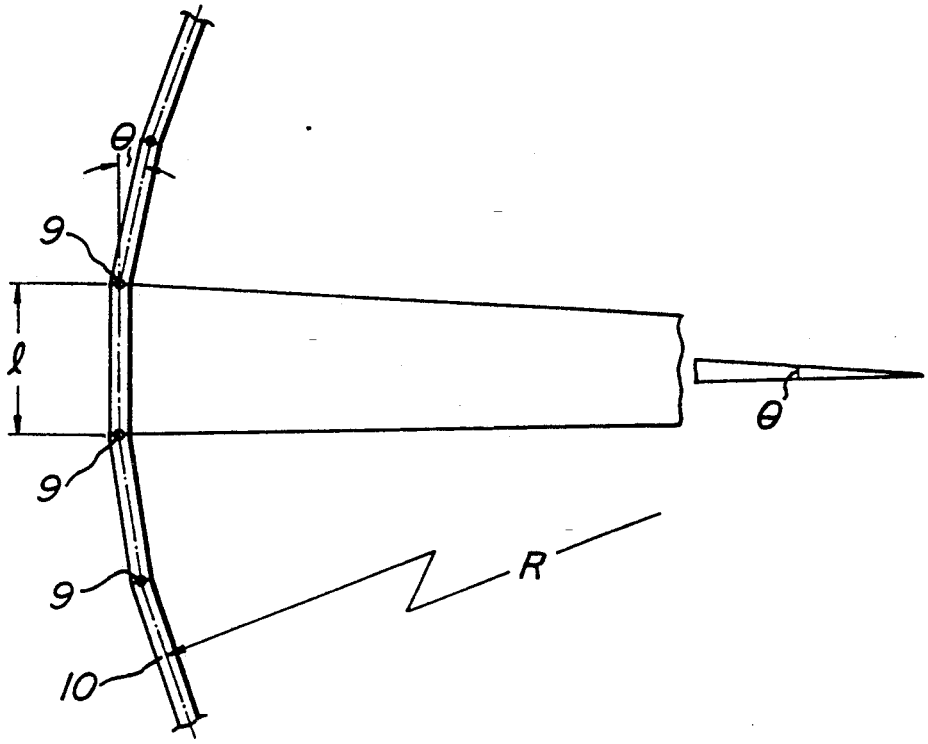
FIG. 5 is a partially enlarged schematic view of FIG. 3.
Figure 6:
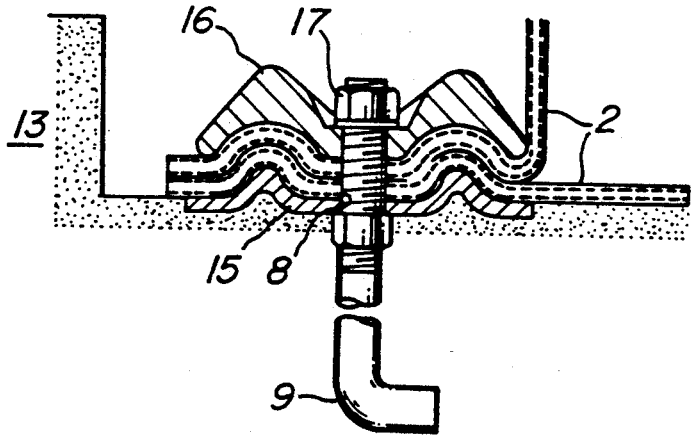
FIG. 6 is a side sectional view of a fastening portion of the flexible rubber sheet body.

In FIG. 5 enlargedly showing a part of the fastening portion 10 of FIG. 3, for example, when a radius R of the arc form is 100 m and the unit length l between the anchor bolts 9 in the fastening portion 10 is 1.2 m, $\theta=0.012$ rad$=0.69°$ from a relation of $\theta \simeq l/R$ (rad).

Figure 7:
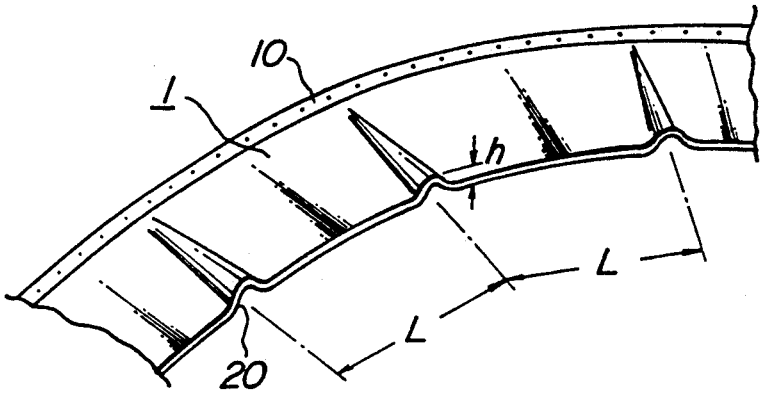
FIG. 7 is a perspective view showing a deflated state of the flexible rubber sheet body.

Moreover, when the straight fastening portion 10 of the rubber sheet body 1 is fixed in the arc form as mentioned above, compressive force in circumferential direction are applied to the folded edge of the sheet body 1 at the downstream side from the relation of arc length in the deflation of the sheet body to thereby create wrinkles 20 as shown in FIG. 7. The distance L between the wrinkles 20 and the height h of the wrinkle 20 are dependent upon not only the curvature of radius and the length from the edge of the fastening portion to the folded edge (substantially corresponding to dam height) but also the thickness, rigidity and the like of the rubberized cloth 2.

Figure 8A:
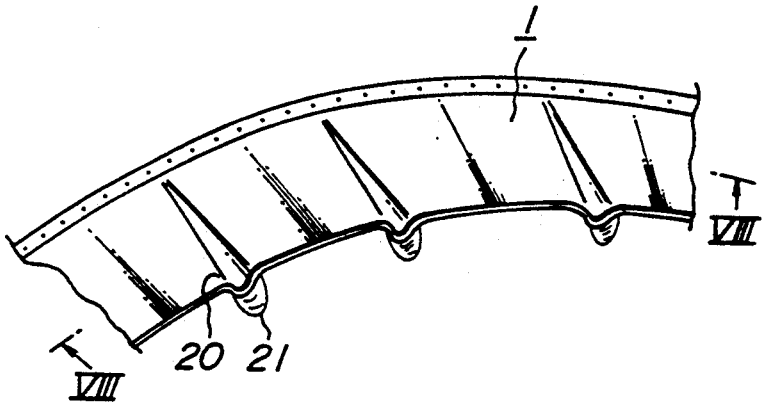
FIG. 8*a* is a perspective view showing a state that the flexible rubber sheet body is fixed on a base portion of the spillway provided with concave grooves.
Figure 8B:
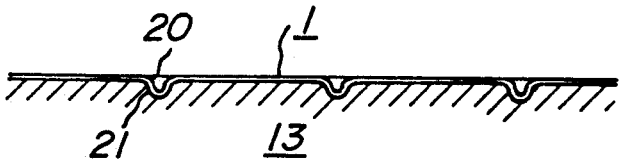
FIG. 8*b* is a sectional view taken along a line VIII—VIII of FIG. 8*a;*
Figure 9A:
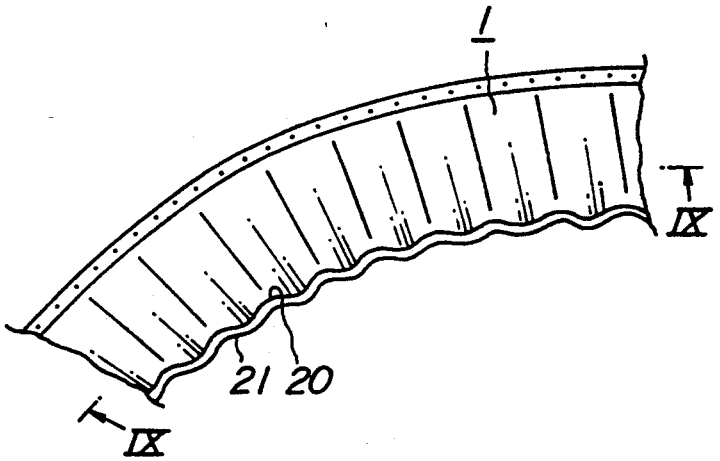
FIG. 9*a* is a perspective view showing another state that the flexible rubber sheet body is fixed on a base portion of the spillway provided with concave grooves.
Figure 9B:
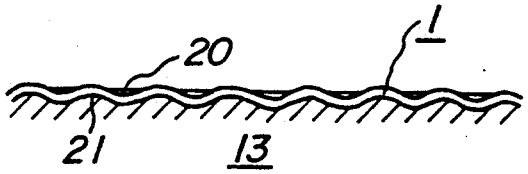
FIG. 9*b* is a sectional view taken along a line IX—IX of FIG. 9*a*.

When the large wrinkles 20 are formed, there may be caused a fear that the portions of the sheet body 1 corresponding to the wrinkles are damaged by the collision with drifting matter such as rolling stones, drifting wood and the like. In this case, as shown in FIGS. 8 and 9, concave grooves 21 for absorbing wrinkles are formed in the concrete base of the spillway portion 13 attaching the rubber sheet body 1 at a given interval (see FIGS. 8*a* and 8*b*) or continuously (see FIGS. 9*a* and 9*b*), whereby the wrinkles 20 produced in the deflation of the sheet body 1 are housed in these grooves 21. That is, even when the unevenness is created in the rubber sheet body 1 through the wrinkles, the size of the unevenness is merely a small wavy undulation owing to the presence of the grooves 21.

Figure 10:
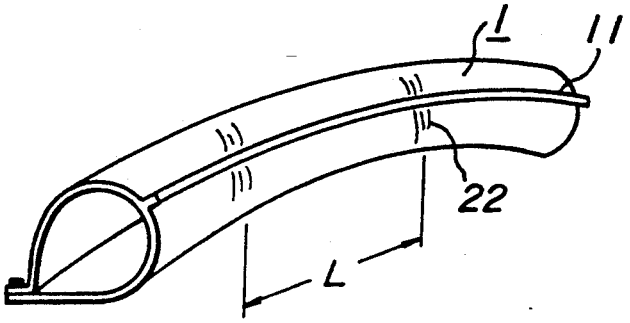
FIG. 10 is a perspective view showing an inflated state of the flexible rubber sheet body.

As shown in FIG. 10, wrinkles 22 are formed at the downstream side even in the inflation of the rubber sheet body 1. Since the inflated height of the sheet body 1 is usually very small as compared with the radius of curvature, the function of the rubber sheet body 1 is not affected by the presence of wrinkles 22 and also there is no problem of damaging the appearance.

If necessary, it is possible to render the fastening portion 10 and the folded edge 3 of the rubberized cloth 2 into an arc form having the same curvature center for creating no wrinkles.

In the above illustrated embodiment, the rubber sheet body 1 is not arranged in the folded form but is arranged in a curved form as a whole, so that the use of a pier is not required. Furthermore, the straight fastening portion 10 of the rubber sheet body 1 is fixed along the arc of the spillway portion 13 while being successively bent at a very small angle, so that the working execution is easy and there is no problem in the airtightness. Moreover, there is caused no shifting of fastening positions even in case of using the pier, so that the inflated height of the rubber sheet body 1 is substantially equal over its full length and the given amount of water can surely be reserved without creating the local difference in the depth of overflowing water.

Figure 11:
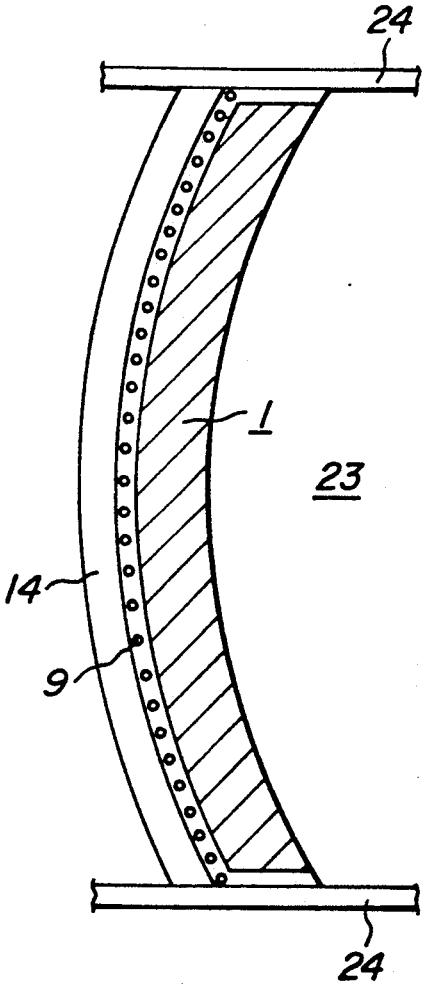
FIG. 11 is a plan view showing a state of arranging the flexible rubber sheet body in a watercourse of a river.
Figure 12:
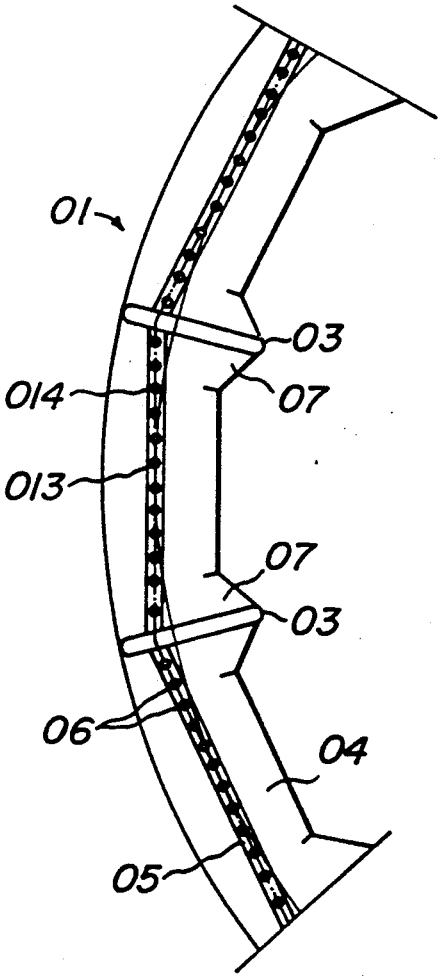
FIG 12 PRIOR ART
FIG. 12 is a schematic view showing a state of attaching the conventional flexible rubber bag onto the arch type concrete dam.
Figure 13:
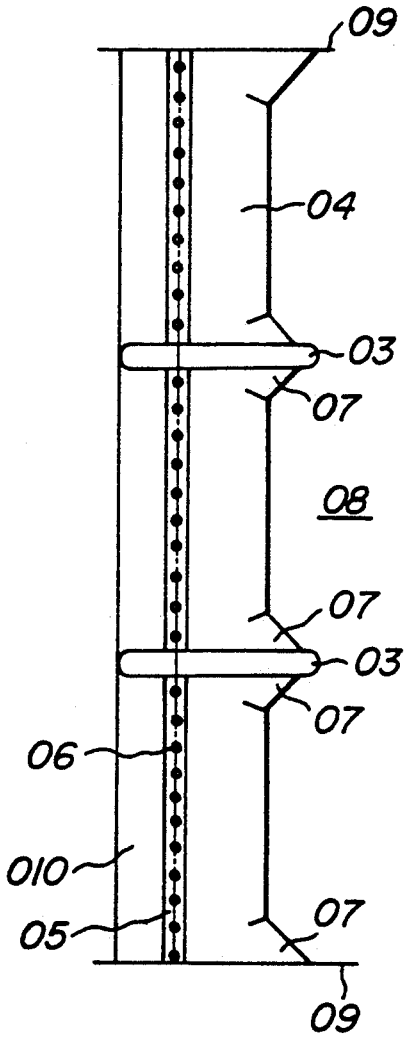
FIG. 13 PRIOR ART
FIG. 13 is a schematic view showing a state of arranging the conventional rubber bag in a watercourse of a river.

FIG. 11 illustrates a state of arranging the rubber sheet body 1 in a river, wherein a concrete is placed on a riverbed 23 and both riverbanks 24 to from an arc-shaped concrete base 14 anchor bolts 9 are embedded in the concrete base 14 and then the rubber sheet body 1 is fixed to the concrete base 14 through the anchor bolts 9 in the same manner as described above.

In the embodiment of FIG. 11, rubber sheet body 1 takes the arc shape, so that overflowing water does not fall down in parallel to the riverbank but falls down an inward watercourse, and consequently the riverbanks located at the downstream side of the rubber sheet body 1 are not damaged by the overflowing water, drifting matter such as stones, drifting wood and the like. Further, the overflowing length in the widthwise direction of the river becomes longer as compared with the case of straightforwardly arranging the rubber sheet body in the widthwise direction of the river, so that when the flowing rate is same, the overflowing height can be lowered. As a result, high overflowing water can be reduced to mitigate vibrations of the inflated rubber sheet body 1, resulting in the reduction of deflation number against the regulation waterlevel.

As mentioned above, according to the invention, the flexible rubber sheet body is fixed in a curved form onto a spillway portion of an arch type concrete dam or onto a riverbed without using piers, so that the working execution is easy and the dam height is uniform as a whole in the longitudinal direction of the sheet body. Furthermore, in case of the river, the damage of the riverbank by the drifting matter is prevented and the vibration of the rubber sheet body is mitigated.

What is claimed is:

1. A collapsible rubber dam for an arch type concrete dam, comprising; a flexible rubber sheet body inflated and deflated through supply and discharge of air, said flexible rubber sheet being folded and fixed at both free ends to define a fastening portion onto an upper spillway portion of said arch type concrete dam in a curved form in a longitudinal direction of the flexible rubber sheet body at a position toward an upstream side thereof.

2. The collapsible rubber dam of claim 1 further comprising bolt holes in said fastening portion and a series of anchor bolts in said bolt holes arranged in an arc on said concrete dam.

3. The collapsible rubber dam of claim 1 further comprising a pair of slant edges on sides of said flexible rubber sheet body, said slant edge fixed to sidewalls of said dam.

4. The collapsible rubber dam of claim 1, wherein arch type concrete dam comprises an arch-shaped concrete base and curved upper spillway portion, said flexible rubber dam body conforming to said curved upper spillway portion when in a deflated state.

5. The collapsible rubber dam of claim 4 further comprising a series of anchor bolts embedded in said curved upper spillway on an upstream side thereof to affix said flexible rubber dam body to said arc type concrete dam.

* * * * *